US005437323A

United States Patent [19]

Holden

[11] Patent Number: 5,437,323

[45] Date of Patent: Aug. 1, 1995

[54] BURGLAR DETERRENT DECOY

[76] Inventor: Jeffery M. Holden, 20515 Aldine Westfield #67, Humble, Tex. 77338

[21] Appl. No.: 82,534

[22] Filed: Jun. 25, 1993

[51] Int. Cl.[6] ..... E06B 9/38

[52] U.S. Cl. ..... 160/178.1; 160/10; 40/538

[58] Field of Search ..... 160/178.1 R, 10, 349.1, 160/349.2; 223/66; 40/538, 617

[56] References Cited

U.S. PATENT DOCUMENTS

| | | | |
|---|---|---|---|
| 2,180,219 | 11/1939 | Wormley | 160/349.2 |
| 2,749,072 | 6/1956 | Long | 160/178.1 R X |
| 2,822,868 | 2/1958 | Roberts | 160/178.1 R X |
| 3,197,093 | 7/1965 | Doran | 223/66 |
| 4,196,536 | 4/1980 | Westberg | 40/159 |
| 4,217,713 | 8/1980 | Greenberger | 40/488 |
| 4,940,622 | 7/1990 | Leavitt, Sr. et al. | 428/137 |
| 5,074,351 | 12/1991 | Sandler | 160/178.1 R |

*Primary Examiner*—Blair M. Johnson
*Attorney, Agent, or Firm*—Richard L. Miller

[57] ABSTRACT

A burglar deterrent decoy is provided which consists of a partial face mask with simulated eyes and nose, which is mounted to a side jamb of a window in an exterior wall of a building behind a window blind. A slat of the window blind is retained in front of the partial face mask in a bent up raised position when desired, so as to produce an illusion that a person is looking out through the window blind to scare away a burglar.

4 Claims, 1 Drawing Sheet

BURGLAR DETERRENT DECOY

BACKGROUND OF THE INVENTION

The instant invention relates generally to sign displays and more specifically it relates to a burglar deterrent decoy.

Numerous sign displays have been provided in the prior art that are capable of supplying information and images to the public. For example, U.S. Pat. Nos. 4,196,536 to Westberg; 4,217,713 to Greenberger and 4,940,622 to Leavitt Sr. et al. all are illustrative of such prior art. While these units may be suitable for the particular purpose to which they address, they would not be as suitable for the purpose of the present invention as hereafter described.

SUMMARY OF THE INVENTION

A primary object of the present invention is to provide a burglar deterrent decoy that will overcome the shortcomings of the prior art devices.

Another object is to provide a burglar deterrent decoy in which a partial face mask with eyes and nose which is mounted to a bracket for securing on a window side jamb behind a window blind, so as to produce an illusion that a person is looking out through the window blind to scare away a burglar.

An additional object is to provide a burglar deterrent decoy that is adjustable to the bracket, so it can fit properly behind a bent up slat of the window blind.

A further object is to provide a burglar deterrent decoy that is simple and easy to use.

A still further object is to provide a burglar deterrent decoy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
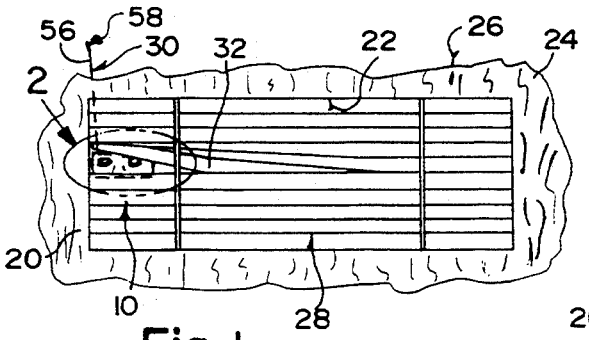
FIG. 1 is a diagrammatic front view illustrating the instant invention installed behind a typical window blind.
Figure 2:
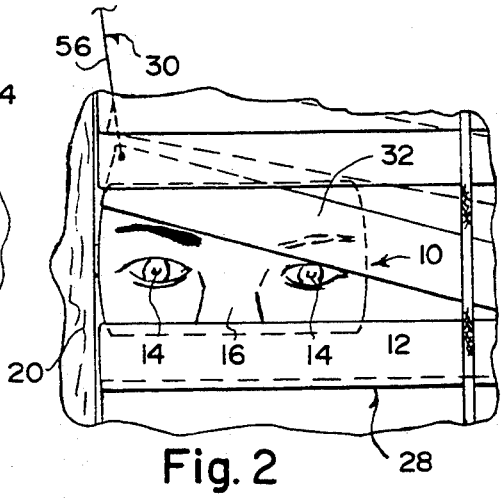
FIG. 2 is a greatly enlarged front view with parts broken away of the area indicated by arrow 2 in FIG. 1.

Turning now descriptively to the drawings, in which similar reference characters denote similar elements throughout the several views, FIGS. 1 through 4 illustrate a burglar deterrent decoy 10 which consists of a partial face mask 12 with simulated eyes 14 and nose 16.

A device 18 is for mounting the partial face mask 12 to a side jamb 20 of a window 22 in an exterior wall 24 of a building 26 behind a window blind 28. An apparatus 30 is for retaining a slat 32 of the window blind 28 in front of the partial face mask 12 in a bent up raised position, so as to produce an illusion that a person is looking out through the window blind 28 to scare away a burglar.

Figure 4:
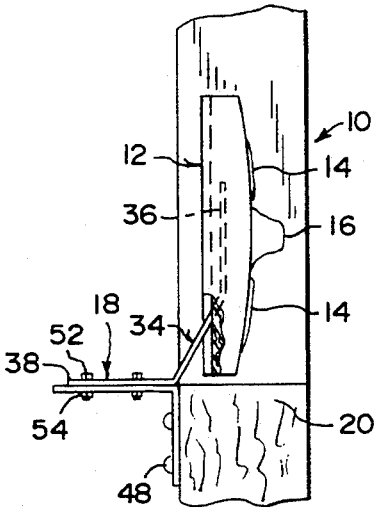
FIG. 4 is a diagrammatic top view with parts broken away taken in the direction of arrow 4 in FIG. 3 of the instant invention installed on a window side jamb.
Figure 3:
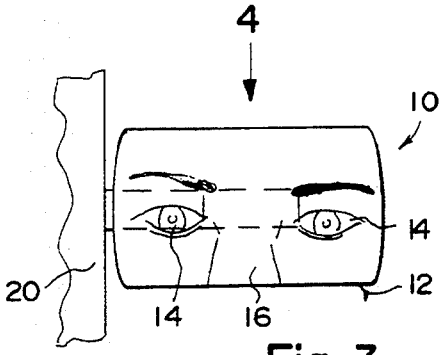
FIG. 3 is a front view similar to FIG. 2, but with the blind removed for clarity.
Figure 5:
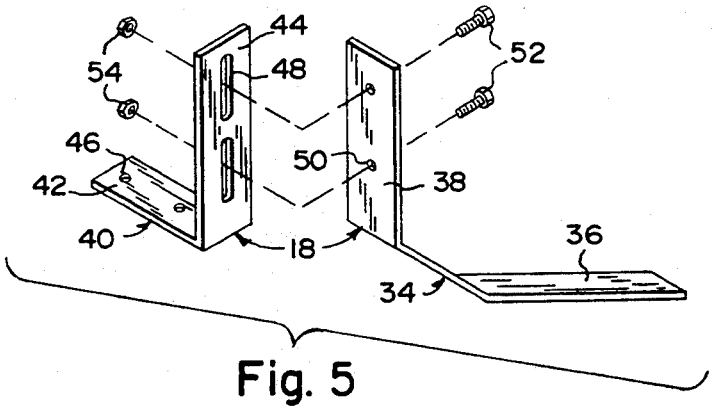
FIG. 5 is an enlarged diagrammatic exploded view of the adjustable bracket for use in the installation thereof.

As best seen in FIGS. 4 and 5, the mounting device 18 includes a bent arm 34 having a first segment 36 imbedded within the partial face mask 12 and a second segment 38 extending from one side thereof. An L-shaped bracket 40 is also provided having a first leg 42 and a second leg 44. The first leg 42 is affixed to the side jamb 20 of the window 22. The second leg 44 is affixed in an adjustable manner to the second segment 38 of the bent arm 34.

The first leg 42 of the L-shaped bracket 40 has a plurality of holes 46 therethrough. A fastener 48 extends through each hold and into the side jamb 20 of the window 22.

The second leg 44 of the L-shaped bracket 40 has a plurality of slotted holes 48 therethrough. The second segment 38 of the bent arm 34 has a plurality of holes 50 therethrough. A bolt 52 extends through each hole 50 in the second segment 38 of the bent arm 34 and the matching slotted hole 48 in the second leg 44 of the L-shaped bracket 40, so that the second segment 38 can slide with respect to the second leg 44. A nut 54 is connected to each bolt 52, so as to hold the second segment 38 in a stationary position thereto.

The retaining apparatus 30 contains a line 56 attached at a first end to a distal free end of the slat 32 of the window blind 28. A tack 58 is engaged with a second end of the line 56 and is pressed into a rear surface of the exterior wall 24 above the window 22, so as to keep the slat 32 in the bent up raised position, when desired.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A burglar deterrent decoy, which comprises:

a) a partial face mask with simulated eyes and nose;

b) means for mounting said partial face mask to a side jamb of a window in a wall of a building behind a window blind; wherein said mounting means includes:

i) a bent arm having a first segment imbedded within said partial face mask and a second segment extending from one side thereof;

ii) an L-shaped bracket having a first leg and a second leg;

iii) first means for affixing said first leg to the side jamb of the window; and iv) second means for affixing said second leg in an adjustable manner to said second segment of said bent arm; and c) means for retaining a slat of the window blind in front of said partial face mask in a bent up raised position, so as to produce an illusion that a person is looking out through the window blind to scare away a burglar.

2. A burglar deterrent decoy as recited in claim 1, wherein said first means for affixing includes:

a) said first leg of said L-shaped bracket having a plurality of holes therethrough; and b) a plurality of fasteners, each extending through one of said holes and into the side jamb of the window.

3. A burglar deterrent decoy as recited in claim 2, wherein said second means for affixing includes:

a) said second leg of said L-shaped bracket having a plurality of slotted holes therethrough;

b) said second segment of said bent arm having a plurality of holes therethrough;

c) a plurality of bolts, each extending through one said hole in said second segment of said bent arm and said matching slotted hole in said second leg of said L-shaped bracket, so that the said second segment can slide with respect to said second leg; and d) a plurality of nuts, each connected to one said bolt, so as to hold said second segment in a stationary position thereto.

4. A burglar deterrent decoy as recited in claim 3, wherein said retaining means includes:

a) a line attachable at a first end to a distal free end of the bent up slat of the window blind; and b) a tack engaged with a second end of said line and pressed into a rear surface of the exterior wall above the window, so as to keep the slat in a bent up raised position, when desired.

* * * * *